US011280277B1

(12) United States Patent
Aquino

(10) Patent No.: US 11,280,277 B1
(45) Date of Patent: Mar. 22, 2022

(54) SYSTEMS AND METHODS FOR ENGINE COMBUSTION MODELING AND CONTROL

(71) Applicant: Honda Motor Co., Ltd., Tokyo (JP)

(72) Inventor: Phillip Andrew Aquino, Columbus, OH (US)

(73) Assignee: HONDA MOTOR CO., LTD., Tokyo ( * ) Notice: Subject to any disclaimer, the term of this patent is extended or adjusted under 35 U.S.C. 154(b) by 0 days.

(21) Appl. No.: 17/176,555

(22) Filed: Feb. 16, 2021

(51) Int. Cl.
*F02D 35/00* (2006.01)
*F02D 35/02* (2006.01)
*F02D 41/14* (2006.01)

(52) U.S. Cl.
CPC ..... *F02D 35/023* (2013.01); *F02D 35/028* (2013.01); *F02D 2041/1433* (2013.01); *F02D 2200/0402* (2013.01); *F02D 2200/0406* (2013.01)

(58) Field of Classification Search
CPC ..... F02D 35/023; F02D 35/028; F02D 2200/0406; F02D 2200/0402; F02D 2041/1433
See application file for complete search history.

(56) References Cited

U.S. PATENT DOCUMENTS 5,665,916 A * 9/1997 Puster ..... F23N 5/16 73/114.43
5,975,046 A * 11/1999 Kaneko ..... F02P 5/153 123/300
2005/0000855 A1* 1/2005 Farrell ..... C10L 1/06 208/16
2016/0377043 A1* 12/2016 Wang ..... F02D 41/1406 701/111
2018/0135548 A1* 5/2018 Stefanopoulou .... F02D 41/1498

* cited by examiner

*Primary Examiner* — Phutthiwat Wongwian
*Assistant Examiner* — Sherman D Manley
(74) *Attorney, Agent, or Firm* — Rankin, Hill & Clark LLP

(57) ABSTRACT

The systems and methods are generally directed to engine combustion modeling of an engine having a combustion chamber. In one embodiment, a method includes determining the thermodynamic state of the engine combustion chamber based on received engine parameters. The laminar flame speeds of the combustible mixture are determined based on tabulated measurement results or from correlations available in the literature. The dynamics of the turbulent flame brush thickness are calculated using a 1D nonlinear ordinary differential equation. The mass fraction burned ratio is found by tracking the motion of a presumed truncated spherical flame front as it propagates through the combustion chamber using the mass continuity equation. One or more engine control calibration efficiency factors are then determined based on the resultant mass fraction burned ratio. One or more efficiency factors control at least one aspect of the engine.

20 Claims, 7 Drawing Sheets

SYSTEMS AND METHODS FOR ENGINE COMBUSTION MODELING AND CONTROL

BACKGROUND

The design and control of an internal combustion engine typically requires numerous experiments to be performed in order to quantify the behavior of the combustion system across a range of operating conditions. In particular, the burning rate of the combustible mixture must be understood in order to properly control combustion phasing so that efficient mechanical work can be generated. Numerical modeling of the combustion process has been attempted to determine the proper ignition timing prior to obtaining measurements of the combustion phasing behavior. However, engine combustion models are typically based on conventional theories of turbulent flame kinematics and therefore require calibrations from the specific hardware and operating conditions under consideration. This reduces the general utility of these models for predictive purposes and therefore it is still necessary today to perform detailed experimentation to collect information about the combustion system behavior that has no other source.

BRIEF DESCRIPTION

According to one or more aspects, a computer-implemented method for engine combustion modeling is provided. The method includes determining a physical state of the engine based on received engine parameters. Laminar flame speeds of a flame in the combustion chamber are calculated based on the physical state of the engine. Flame brush thickness dynamics including flame brush growth and flame brush decay are calculated. The flame brush growth is based on the received engine parameters and the flame brush decay is based on the laminar flame speed. The method also includes calculating a mass burned fraction based on the turbulent flame speed. One or more efficiency factors are determined based on the mass burned fraction. The one or more efficiency factors control at least one aspect of the engine.

According to one or more aspects, a system for engine combustion modeling is provided. The system includes an engine kinematics module, an engine thermodynamics module, a flame kinematics module, and a combustion module. The engine thermodynamics module determines a physical state of the engine based on received engine parameters. The laminar flame module calculates a laminar flame speed of a flame in the combustion chamber based on the physical state of the engine. The flame kinematics module calculates flame brush thickness dynamics including flame brush growth and flame brush decay. The flame brush growth is based on the received engine parameters and the flame brush decay is based on the laminar flame speed. The flame kinematics module also calculates a mass burned fraction based on the flame brush thickness dynamics. The combustion module determines one or more efficiency factors based on the mass burned fraction. The one or more efficiency factors control at least one aspect of the engine.

According to one or more aspects, non-transitory computer-readable storage medium storing instructions that, when executed by a computer, causes the computer to perform a method for engine combustion modeling. The method includes determining a physical state of the engine based on received engine parameters. A laminar flame speed of a flame in the combustion chamber is calculated based on the physical state of the engine. Flame brush thickness dynamics including flame brush growth and flame brush decay are calculated. The flame brush growth is based on the received engine parameters and the flame brush decay is based on the laminar flame speed. The method also includes calculating a mass burned fraction based on the turbulent flame speed. One or more efficiency factors are determined based on the mass burned fraction. The one or more efficiency factors control at least one aspect of the engine.

DETAILED DESCRIPTION

Figure 1:
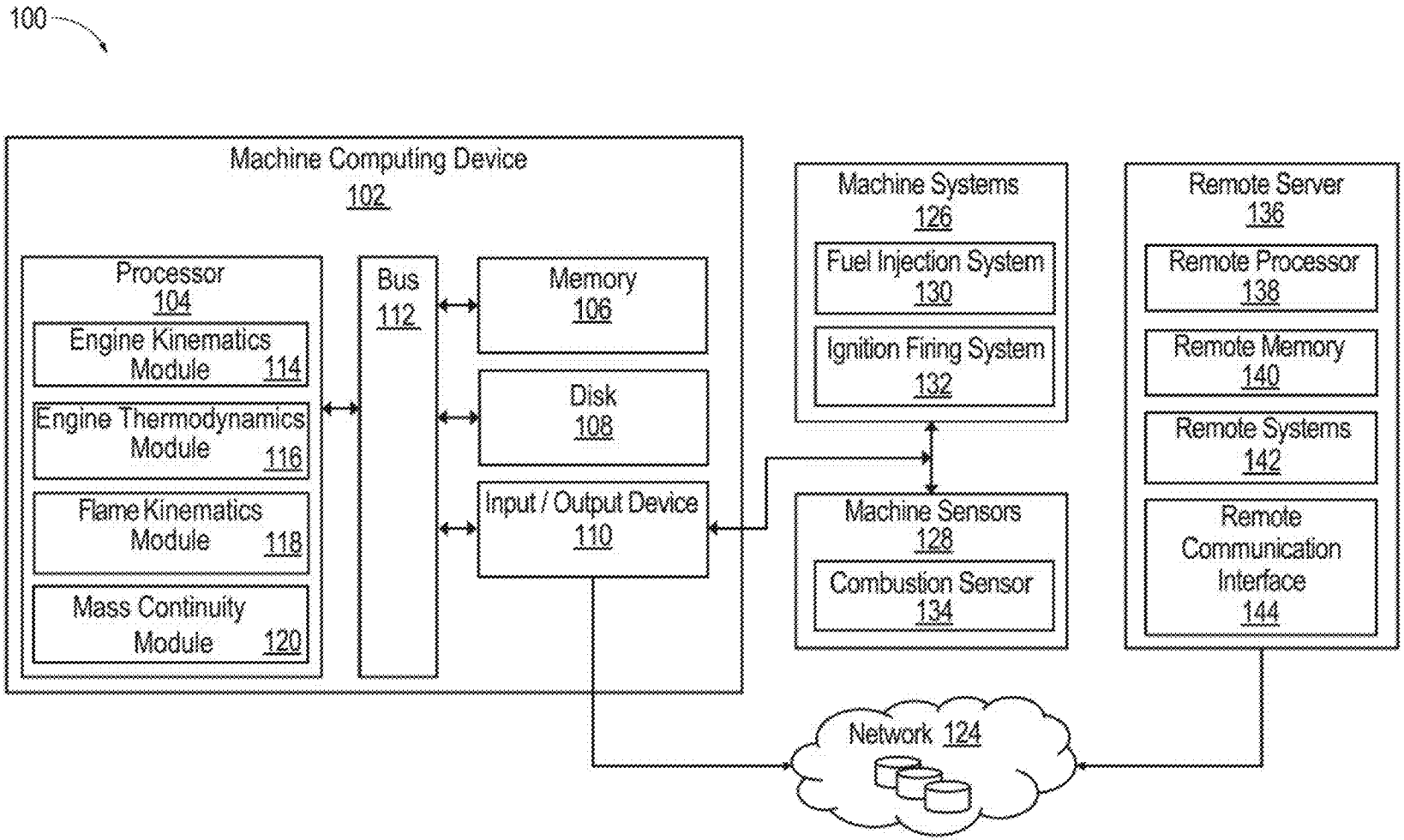
FIG. 1 is a schematic diagram of an exemplary operating environment for engine combustion modelling according to an exemplary embodiment.

Generally, the systems and methods disclosed herein are directed to modeling combustion in an internal combustion engine in a low fidelity description of the physical processes involved (0D or 1D). In particular, the systems and methods described herein address accurate modeling of the combustion in a real time environment necessary for controls purposes. The turbulent motion within the combustion chamber consists of swirling motion and eddies across a wide spectrum of length and time scales. These turbulent motions cause the propagating flame to be wrinkled and irregular which tends to amplify the turbulent flame speed to values much larger than the associated laminar values. Accounting for theses detailed interactions between the locally laminar flame and the turbulent flow structure directly is too computationally expensive for real time control purposes. Instead, correlations of steady state turbulent flame speed may be used as a function of various statistical turbulent quantities to represent the interaction between chemistry and turbulence. No general consensus exists on what parameters are necessary to account for these interactions in a general way, and so the correlations must be calibrated for the specific hardware and operating point under consideration. Ultimately this means any combustion model using turbulent flame speed correlations must require some information from the specific problem under consideration in order to represent the dynamics of that system and is therefore not truly a prediction made in isolation which limits the utility of the model results. The disclosed systems and methods resolve these issues by allowing an accurate prediction of the transient turbulent flame to be made without use of hardware specific experimental calibration through the application of a 1D nonlinear ordinary differential equation which can be calculated on the meager processing resources typically available for controls purposes.

Prior attempts to model engine combustion require experimental feedback loops that are resource and time intensive in order to determine model calibrations for the generally non-predictive turbulent flame speed correlations. For example, suppose an engine is being tested to determine the effects of a first condition. The engine must be setup to perform under the first condition, the performance of the system is measured and a simulation is generated based on that measured performance. The simulation output can then be calibrated to enhance the agreement between model and experiment. If a second condition is to be modeled, the engine experiment must be performed again to determine the performance of the second condition, and the model will then have a separate set of calibrations for this second condition. This process will repeat for each condition of interest, creating a very expensive and necessary feedback loop. The systems and methods described herein largely eliminate this feedback loop by eliminating the main source of necessary model calibration, accurate prediction of the transient turbulent flame speed within a low fidelity internal combustion engine model.

Here, systems and methods are provided for engine combustion modeling that is usable as a combustion phasing controller. In particular, rather than using calibrated turbulent flame speed correlations, the systems and methods herein calculate the transient turbulent flame speed by directly determining the turbulent flame brush thickness dynamics from a 1D nonlinear ordinary differential equation. This model represents a low fidelity description of the actual turbulent flame propagation physics and so the models described herein can be used to calculate an accurate result of the turbulent flame speed with little computational overhead. Accordingly, these models have a strong connection to the actual physics of a propagating turbulent flame despite the low fidelity representation, making it valuable for use as a combustion phasing controller that requires little model calibration across a wide range of engine operating conditions.

Definitions

The following includes definitions of selected terms employed herein. The definitions include various examples and/or forms of components that fall within the scope of a term and that can be used for implementation. The examples are not intended to be limiting. Furthermore, the components discussed herein, can be combined, omitted, or organized with other components or into different architectures.

"Bus," as used herein, refers to an interconnected architecture that is operably connected to other computer components inside a computer or between computers. The bus can transfer data between the computer components. The bus can be a memory bus, a memory processor, a peripheral bus, an external bus, a crossbar switch, and/or a local bus, among others. The bus can also be a vehicle bus that interconnects components inside a vehicle using protocols such as Media Oriented Systems Transport (MOST), Controller Area network (CAN), Local Interconnect network (LIN), among others.

"Component," as used herein, refers to a computer-related entity (e.g., hardware, firmware, instructions in execution, combinations thereof). Computer components may include, for example, a process running on a processor, a processor, an object, an executable, a thread of execution, and a computer. A computer component(s) can reside within a process and/or thread. A computer component can be localized on one computer and/or can be distributed between multiple computers.

"Computer communication," as used herein, refers to a communication between two or more communicating devices (e.g., computer, personal digital assistant, cellular telephone, network device, vehicle, vehicle computing device, infrastructure device, roadside equipment) and can be, for example, a network transfer, a data transfer, a file transfer, an applet transfer, an email, a hypertext transfer protocol (HTTP) transfer, and so on. A computer communication can occur across any type of wired or wireless system and/or network having any type of configuration, for example, a local area network (LAN), a personal area network (PAN), a wireless personal area network (WPAN), a wireless network (WAN), a wide area network (WAN), a metropolitan area network (MAN), a virtual private network (VPN), a cellular network, a token ring network, a point-to-point network, an ad hoc network, a mobile ad hoc network, a vehicular ad hoc network (VANET), a vehicle-to-vehicle (V2V) network, a vehicle-to-everything (V2X) network, a vehicle-to-infrastructure (V2I) network, among others. Computer communication can utilize any type of wired, wireless, or network communication protocol including, but not limited to, Ethernet (e.g., IEEE 802.3), WiFi (e.g., IEEE 802.11), communications access for land mobiles (CALM), WiMax, Bluetooth, Zigbee, ultra-wideband (UWAB), multiple-input and multiple-output (MIMO), telecommunications and/or cellular network communication (e.g., SMS, MMS, 3G, 4G, LTE, 5G, GSM, CDMA, WAVE), satellite, dedicated short range communication (DSRC), among others.

"Communication interface" as used herein can include input and/or output devices for receiving input and/or devices for outputting data. The input and/or output can be for controlling different vehicle features, which include various vehicle components, systems, and subsystems. Specifically, the term "input device" includes, but is not limited to: keyboard, microphones, pointing and selection devices, cameras, imaging devices, video cards, displays, push buttons, rotary knobs, and the like. The term "input device" additionally includes graphical input controls that take place within a user interface which can be displayed by various types of mechanisms such as software and hardware-based controls, interfaces, touch screens, touch pads or plug and play devices. An "output device" includes, but is not limited to, display devices, and other devices for outputting information and functions.

"Computer-readable medium," as used herein, refers to a non-transitory medium that stores instructions and/or data. A computer-readable medium can take forms, including, but not limited to, non-volatile media, and volatile media. Non-volatile media can include, for example, optical disks, magnetic disks, and so on. Volatile media can include, for example, semiconductor memories, dynamic memory, and so on. Common forms of a computer-readable medium can include, but are not limited to, a floppy disk, a flexible disk, a hard disk, a magnetic tape, other magnetic medium, an ASIC, a CD, other optical medium, a RAM, a ROM, a memory chip or card, a memory stick, and other media from which a computer, a processor or other electronic device can read.

"Database," as used herein, is used to refer to a table. In other examples, "database" can be used to refer to a set of tables. In still other examples, "database" can refer to a set of data stores and methods for accessing and/or manipulating those data stores. A database can be stored, for example, at a disk, data store, and/or a memory.

"Data store," as used herein can be, for example, a magnetic disk drive, a solid-state disk drive, a floppy disk drive, a tape drive, a Zip drive, a flash memory card, and/or a memory stick. Furthermore, the disk can be a CD-ROM (compact disk ROM), a CD recordable drive (CD-R drive), a CD rewritable drive (CD-RW drive), and/or a digital video ROM drive (DVD ROM). The disk can store an operating system that controls or allocates resources of a computing device.

"Display," as used herein can include, but is not limited to, LED display panels, LCD display panels, CRT display, plasma display panels, touch screen displays, among others, that are often found in vehicles to display information about the vehicle. The display can receive input (e.g., touch input, keyboard input, input from various other input devices, etc.) from a user. The display can be accessible through various devices, for example, though a remote system. The display may also be physically located on a portable device, mobility device, or vehicle.

"Logic circuitry," as used herein, includes, but is not limited to, hardware, firmware, a non-transitory computer readable medium that stores instructions, instructions in execution on a machine, and/or to cause (e.g., execute) an action(s) from another logic circuitry, module, method and/or system. Logic circuitry can include and/or be a part of a processor controlled by an algorithm, a discrete logic (e.g., ASIC), an analog circuit, a digital circuit, a programmed logic device, a memory device containing instructions, and so on. Logic can include one or more gates, combinations of gates, or other circuit components. Where multiple logics are described, it can be possible to incorporate the multiple logics into one physical logic. Similarly, where a single logic is described, it can be possible to distribute that single logic between multiple physical logics.

"Machine," as used herein, refers to any machine that is at least partially powered by a combustion engine. The term "machine" includes, but is not limited to, cars, trucks, vans, minivans, SUVs, motorcycles, scooters, boats, go-karts, amusement ride cars, rail transport, personal watercraft, aircraft, lawn mowers, snow blowers, leaf blowers, string trimmer, air compressor, etc. The machine may have any type of combustion engine, such as a reciprocating engine (e.g., a two-stroke engine, a four-stroke engine, five-stroke engine, six-stroke engine, crankcase scavenged, blower scavenged, spark ignition, compression ignition, etc.), combustion turbine (e.g., jet turbine, gas turbine, Brayton cycle, etc.), Wankel engine, and forced induction engine, among others.

"Machine system," as used herein can include, but is not limited to, any automatic or manual systems that can be used to enhance the machine, operation, and/or safety. Exemplary machine systems include, but are not limited to, a fuel injection system, an ignition firing system, an electronic stability control system, an anti-lock brake system, a brake assist system, an automatic brake prefill system, a low speed follow system, a cruise control system, a collision warning system, a collision mitigation braking system, an auto cruise control system, a lane departure warning system, a blind spot indicator system, a lane keep assist system, a navigation system, a steering system, a transmission system, brake pedal systems, an electronic power steering system, visual devices (e.g., camera systems, proximity sensor systems), a climate control system, a vehicle suspension system, a vehicle seat configuration system, among others.

"Memory," as used herein can include volatile memory and/or nonvolatile memory. Non-volatile memory can include, for example, ROM (read only memory), PROM (programmable read only memory), EPROM (erasable PROM), and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDRSDRAM), and direct RAM bus RAM (DRRAM). The memory can store an operating system that controls or allocates resources of a computing device.

"Module," as used herein, includes, but is not limited to, non-transitory computer readable medium that stores instructions, instructions in execution on a machine, hardware, firmware, software in execution on a machine, and/or combinations of each to perform a function(s) or an action(s), and/or to cause a function or action from another module, method, and/or system. A module can also include logic, a software-controlled microprocessor, a discrete logic circuit, an analog circuit, a digital circuit, a programmed logic device, a memory device containing executing instructions, logic gates, a combination of gates, and/or other circuit components. Multiple modules can be combined into one module and single modules can be distributed among multiple modules.

"Operable connection," or a connection by which entities are "operably connected," is one in which signals, physical communications, and/or logical communications can be sent and/or received. An operable connection can include a wireless interface, a physical interface, a data interface, and/or an electrical interface.

"Portable device," as used herein, is a computing device typically having a display screen with user input (e.g., touch, keyboard) and a processor for computing. Portable devices include, but are not limited to, handheld devices, mobile devices, smart phones, laptops, tablets, e-readers, smart speakers. In some embodiments, a "portable device" could refer to a remote device that includes a processor for computing and/or a communication interface for receiving and transmitting data remotely.

"Processor," as used herein, processes signals and performs general computing and arithmetic functions. Signals processed by the processor can include digital signals, data signals, computer instructions, processor instructions, messages, a bit, a bit stream, that can be received, transmitted and/or detected. Generally, the processor can be a variety of various processors including multiple single and multicore processors and co-processors and other multiple single and multicore processor and co-processor architectures. The processor can include logic circuitry to execute actions and/or algorithms.

I. System Overview

Figure 2:
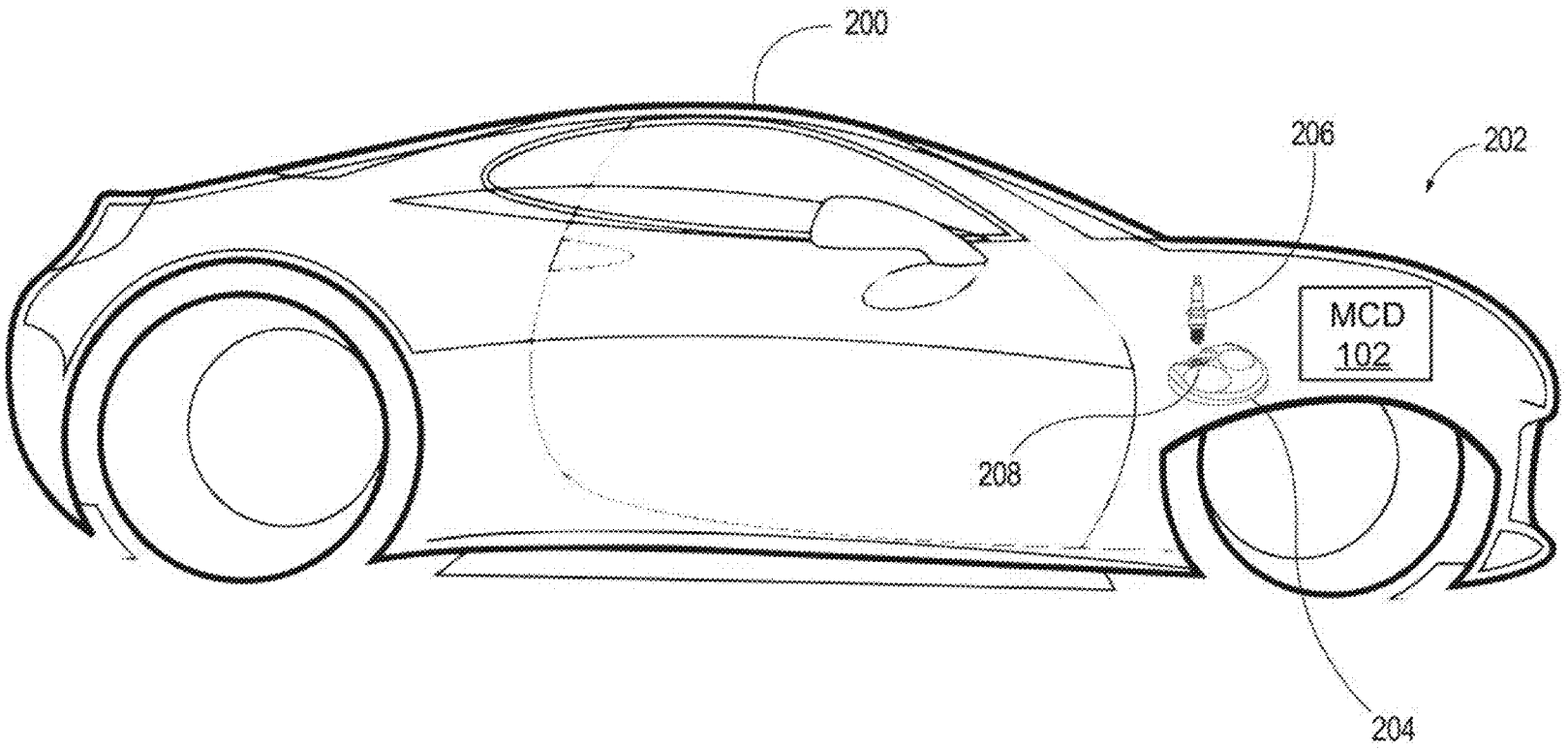
FIG. 2 is a schematic diagram of a machine having an internal combustion engine with a combustion chamber according to one or more embodiments.

Referring now to the drawings, the showings are for purposes of illustrating one or more exemplary embodiments and not for purposes of limiting the same. FIG. 1 is a schematic diagram of an operating environment 100 for engine combustion modeling. The components of operating environment 100, as well as the components of other systems, hardware architectures, and software architectures discussed herein, can be combined, omitted, or organized into different architectures for various embodiments. Further, the components of the operating environment 100 can be implemented with or associated with a machine. In one embodiment, the machine may be a vehicle, such as the vehicle 200, as shown in FIG. 2. The operating environment 100 will be described with respect to the vehicle 200, but the machine could be any type of machine that is, at least partially, powered by a combustion engine.

In the illustrated embodiment of FIG. 1, the operating environment 100 includes a machine computing device (MCD) 102 with provisions for processing, communicating and interacting with various components of the machine, such as vehicle 200, and other components of the operating environment 100. In one embodiment, the MCD 102 can be implemented in the vehicle 200, for example, as part of a telematics unit, a head unit, a navigation unit, an infotainment unit, an electronic control unit, among others. In other embodiments, the components and functions of the MCD 102 can be implemented remotely from the vehicle 200, for example, with a portable device (not shown), a remote server (e.g., a remote server 136), or another device connected via a network (e.g., a network 124).

Generally, the MCD 102 includes a processor 104, a memory 106, a disk 108, and an input/output (I/O) interface 110, which are each operably connected for computer communication via a bus 112 and/or other wired and wireless technologies. The I/O interface 110 provides software and hardware to facilitate data input and output between the components of the MCD 102 and other components, networks, and data sources, which will be described herein. Additionally, the processor 104 includes an engine kinematics module 114, an engine thermodynamics module 116, a flame kinematics module 118, and a mass continuity module 120 for engine combustion modeling, facilitated by the components of the operating environment 100.

The MCD 102 is also operably connected for computer communication (e.g., via the bus 112 and/or the I/O interface 110) to one or more machine systems 126 and one or more machine sensors 128. The machine systems 126 can include, but are not limited to, any automatic or manual systems that can be used to enhance the machine, such as vehicle 200, operation, and/or safety. Here, as an example, the machine systems 126 include a fuel injection system 130 and an ignition firing system 132. For example, turning to FIG. 2, suppose the vehicle 200 has an engine 202. The engine 202 includes a combustion chamber 204 and a spark plug 206. The fuel injection system 130 controls delivery of fuel to the combustion chamber 204 of the engine 202 of the vehicle 200 based on synchronized timing to propel the vehicle 200. The ignition firing system 132 ignites the air-fuel mixture, for example, using a spark 208 based on the synchronized timing.

The machine systems 126 include and/or are operably connected for computer communication to machine sensors 128. The machine sensors 128 provide and/or sense information associated with the vehicle 200, the vehicle environment, and/or the machine systems 126. Here, the machine sensors 128 include the combustion sensor 134 for detecting one or more engine parameters. For example, the combustion chamber 204 may be monitored by a combustion sensor 134 of the machine sensors 128. In one embodiment, the combustion chamber pressure, temperature and combustion phasing can be monitored by a chamber mounted pressure transducer and subsequent analysis of the recorded signal. The combustion sensor 134, such as a pressure transducer, may provide sensor data to a machine system 126, such as the fuel injection system 130.

The machine sensors 128 can also include, but are not limited to, image sensors, such as cameras, optical sensors, radio sensors, electromagnetic sensors, etc. mounted to the interior or exterior of the vehicle 200. The machine sensors 128 may detect one or more engine parameters, such as the position, timing, velocity, engine speed, intake manifold pressure, incoming air mass of per cycle, air to fuel ratio, trapped residual gas percentage, ignition timing, etc. of the components. Accordingly, the machine sensors 128 are operable to sense a measurement of data associated with the vehicle 200, the machine environment, and/or the machine systems 126, and generate a data signal indicating said measurement of data. These data signals can be converted into other data formats (e.g., numerical) and/or used by the machine systems 126 and/or the MCD 102 to generate other data metrics and parameters. For example, the data signals may convert the sensor data to values that can be used by the MCD 102.

The MCD 102 is also operatively connected for computer communication to the network 124. It is understood that the connection from the I/O interface 110 and to the network 124 can be facilitated in various ways. For example, through a network connection (e.g., wired or wireless), a cellular data network from a portable device (not shown), a vehicle to vehicle ad-hoc network (not shown), an in-vehicle network (not shown), among others, or any combination of thereof. The network 124 is, for example, a data network, the Internet, a wide area network or a local area network. The network 124 serves as a communication medium to various remote devices (e.g., databases, web servers, remote servers, application servers, intermediary servers, client machines, other portable devices).

The application of systems for and methods for engine combustion modeling of a machine are described with respect to the vehicle 200. As discussed above, the vehicle includes the combustion chamber 204 as well as the spark plug 206 that ignites an air-fuel mixture with a spark 208. However, the vehicle 200 is exemplary in nature and the machine may have more combustion chambers and/or spark plugs, with different positions, arrangements, profiles, geometries, and/or configurations. Alternatively, the machine may not use the spark plug 206 to ignite the air-fuel mixture. For example, the mixture may be ignited by other sources such as a laser ignitor, glow plug, or by controlled auto ignition of the mixture itself.

Using the system and network configuration discussed above, the engine combustion model is implemented as a combustion phasing controller. In one embodiment, the engine kinematics module 114 governs equations including crank train dynamics based on engine parameters, such as engine speed, bore, stroke, and rod length, among others. The engine parameters may also include the mass fraction burn phasing. The outputs of the engine kinematics module 114 may be crank angle, volume, area, piston speed, etc. The engine thermodynamics module 116 may use the engine parameters and inputs and outputs of the engine kinematics module 114, such as the ignition timing, volume, and mass fractioning burned to calculate the pressure, temperature, composition, laminar flame speed, heat release, and heat transfer, among others. The flame kinematics module 118 uses the laminar flame speed, turbulent kinetic energy, integral length scale of turbulence to calculate the flame brush thickness, turbulent flame speed, spherical flame radius, volume fraction burned, the truncated spherical flame radius, and unburned volume. The mass continuity module 120 can then use the turbulent flame speed, spherical flame area, and unburned volume to calculate the mass fraction burned.

II. Methods for Engine Combustion Modelling

Figure 3:
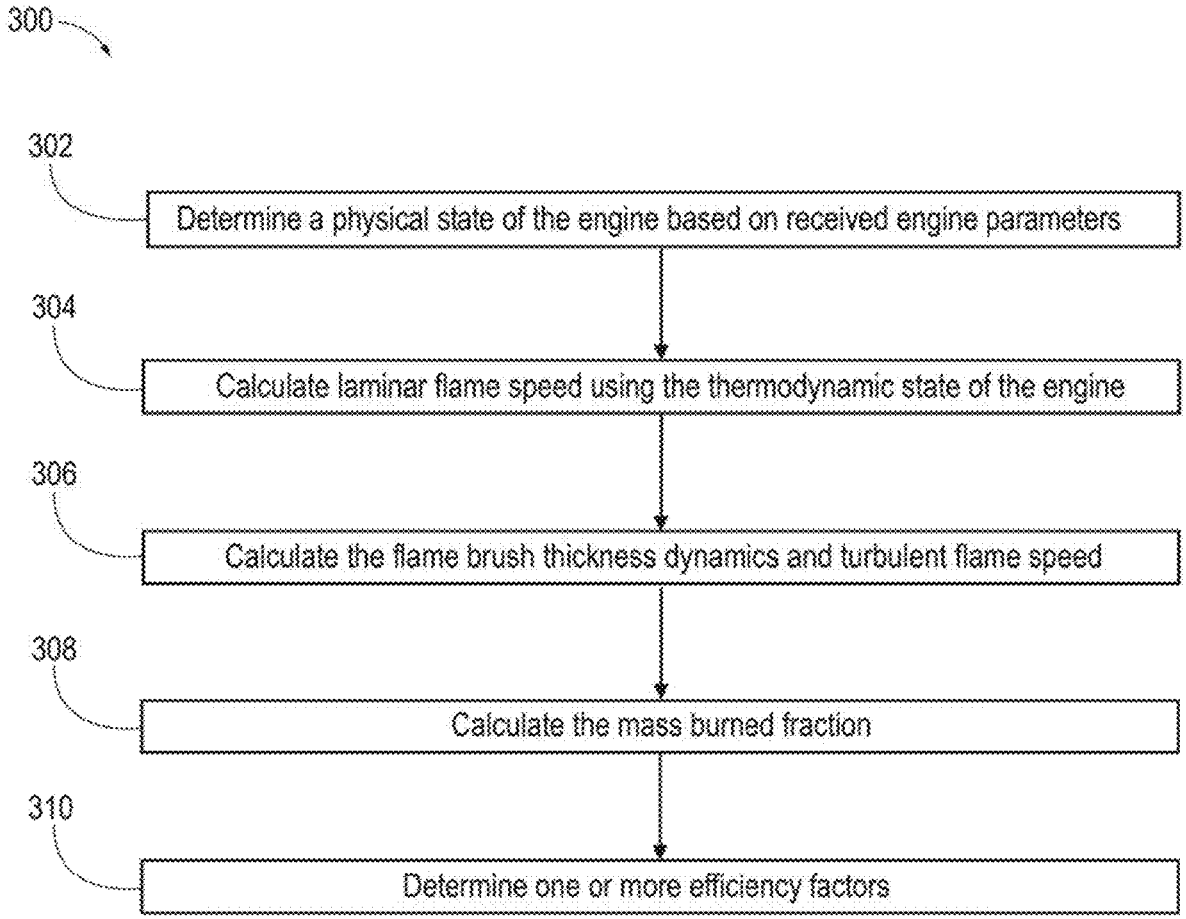
FIG. 3 is a process flow diagram of a method for an internal engine combustion modeling according to an exemplary embodiment.

Referring now to FIG. 3, a method 300 for engine combustion modeling will now be described according to an exemplary embodiment. FIG. 3 will also be described with reference to FIGS. 1, 2, and 4-6. As shown in FIG. 3, the method 300 for engine combustion modeling can be described according to a number of steps for simplicity, but it is understood that the elements of the method 300 can be organized into different architectures, blocks, stages, and/or processes.

At block 302, the method 300 includes determining a physical state of the engine 202 based on one or more received engine parameters. The processes for determining the engine state, that are described below, are performed, coordinated, or facilitated by the engine kinematics module 114. The engine kinematics module 114 may additionally utilize other components of the operating environment 100, including machine systems 126 and the machine sensors 128 shown in FIG. 1.

The physical state describes the current physical state of the engine 202. For example, the physical state of the engine 202 may define an initial condition of the engine 202 as well as boundary conditions of the engine 202. The initial condition may describe the engine 202, including the combustion chamber 204, prior to ignition. The boundary conditions may describe physical constraints based on the engine 202, such as the geometry of the combustion chamber 204. For example, the engine parameters may include the physical state of one or more of the combustion chambers. The received engine parameters may be received from one or more machine systems 126 and/or the machine sensors 128. In other embodiments, the received engine parameters may be stored locally on the MCD 102 or remotely, such as at the remote server 136 and received by the engine kinematics module 114 over the network 124. In yet other embodiments, the received engine parameters may be calculated by the engine kinematics module 114 based on other received engine parameters, sensor data from the machine sensors 128, etc.

The engine parameters may include engine speed, bore, stroke, and rod length, among others. In some embodiments, the engine kinematics module 114 may use crank train dynamics to determine the physical state of the engine 202 including crank angle, volume, area, piston speed, cross reference look up maps for turbulent kinetic energy/integral length scale, etc. The engine parameters may also be received from a machine system 126, such as a combustion phasing controller, and include mass fraction burn phasing for a complete cycle or an efficiency factor. The read module may then output the next iteration of ignition timing.

In another embodiment, the received engine parameters may include information about the air-fuel mixture injected into the combustion chamber 204 or the emissions of the engine 202. In one embodiment, the information about the air-fuel mixture may include received engine parameters that describe the amount of air, the amount of fuel, the amount of residual fuel, thermal diffusivity of the air-fuel mixture, the reaction rate of the air-fuel mixture, the type of fuel (e.g., gasoline, ethanol, etc.), the chemical composition of the fuel (e.g., oxygen, hydrocarbon, etc.), and the humidity of the air, among others. Therefore, the received engine parameters, not only describe the engine 202 of the machine, but also the reactants and products of the operation of the engine 202. Accordingly, the received engine parameters can be used to identify the physical state of the engine 202 such as the thermodynamic conditions (e.g., the air-fuel mixture's chemical properties, the transport properties of the engine 202, etc.) of the engine 202 upon ignition of the air-fuel mixture.

At block 304, the method 300 includes the engine thermodynamics module 116 calculating the laminar flame speed, $s_L$, based on the physical state of the engine 202, such as the thermodynamic state of the engine. The processes for calculating the laminar flame speed, $s_L$, that are described below, are performed, coordinated, or facilitated by the engine thermodynamics module 116. The engine thermodynamics module 116 may additionally utilize other components of the operating environment 100, including machine systems 126 and the machine sensors 128 shown in FIG. 1. The engine thermodynamics module 116 may also utilize conservation equations to determine pressure temperature, composition, heat release, and/or heat transfer.

Figure 4A:
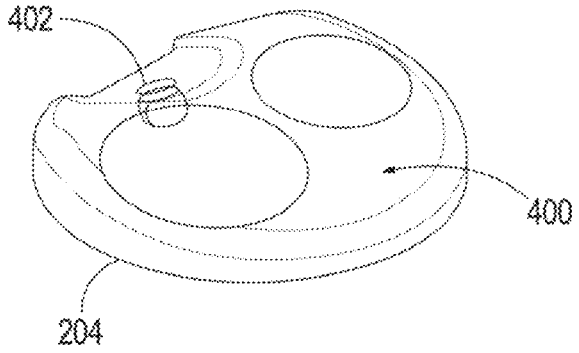
FIG. 4A is a schematic diagram of an exemplary combustion chamber upon ignition according to an exemplary embodiment.
Figure 4B:
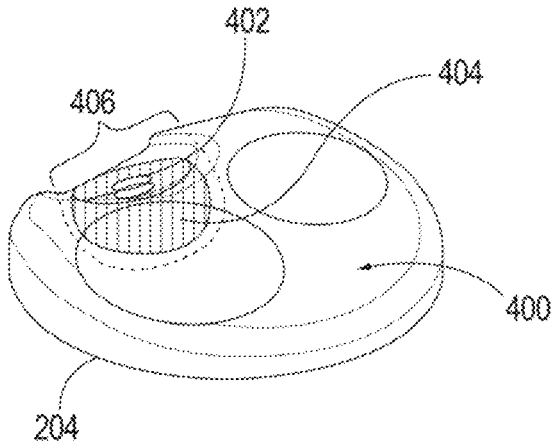
FIG. 4B is a schematic diagram of the exemplary combustion chamber as the flame begins to propagate after ignition according to an exemplary embodiment.
Figure 4C:
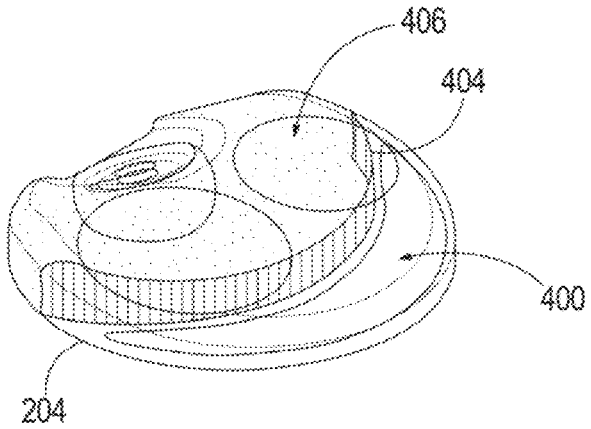
FIG. 4C is a schematic diagram of the exemplary combustion chamber as the flame moves through the combustion chamber according to an exemplary embodiment.

The engine thermodynamics module 116 calculates the laminar flame speed, $s_L$, based on the engine parameters. The laminar flame speed, $s_L$, is the speed at which an un-stretched (i.e., regular) flame will locally propagate through unburned reactants, such as the air-fuel mixture, in the combustion chamber 204. Therefore, the laminar flame speed, $s_L$, is local measurement of the flame front 404. For example, turning to FIG. 4A, suppose the combustion chamber 204 contains an air-fuel mixture that is unburned such that the interior of the combustion chamber 204 is an unburned region 400. The air-fuel mixture is ignited with a catalyst, such as a spark from spark plug 206 that generates a flame at an ignition point 402. The remainder of the combustion chamber 204 is still the unburned region 400. As shown in FIG. 4B, after ignition at the ignition point 402, the flame propagates through the combustion chamber 204 as a flame front 404. The flame front 404 consumes the unburned air-fuel mixture resulting in a burned area 406 as shown in FIG. 4C. Accordingly, the flame front 404 includes the points in the combustion chamber 204 where the chemical reaction is taking place. Also shown in the FIG. 4C, as the flame front 404 moves through the combustion chamber 204, the burned area 406 is left in the wake of the flame front 404 as the flame front 404 progresses through air-fuel mixture in the unburned region 400.

The flame front 404 progresses through the combustion chamber 204 at the laminar flame speed, $s_L$. The laminar flame speed, $s_L$, may not include details about the large-scale flow fields in the combustion chamber 204 that result in turbulence. Instead, the laminar speed, $s_L$, is based on the local properties of the flame front 404, and describes the movement of the flame front 404 based on the physical state of the engine 202 including the chemical nature air-fuel mixture. The laminar flame speed, $s_L$, zooms in on the local properties at the flame front 404, when the large-scale flow fields are not considered, and thus, is a local calculation.

In some embodiments, the engine thermodynamics module 116 may calculate the laminar flame speed, $s_L$, based on the physical state of the engine 202. In another embodiment, the engine thermodynamics module 116 may retrieve the laminar flame speed, $s_L$, from a remote server 136. For example, the engine thermodynamics module 116 may generate a query for the laminar flame speed, $s_L$. The query may include the physical state of the engine 202 having one or more received engine parameters. The engine thermodynamics module 116 transmits the query to the remote server 136. The remote server 136 may receive the query at the remote communication interface 144. The remote processor 138 or the remote systems 142 can then calculate the laminar flame speed, $s_L$. Alternatively, the remote processor may access the remote memory 140 to retrieve the laminar flame speed, $s_L$, based on the query. In one embodiment, the remote memory 140 may access the laminar flame speed, $s_L$, in a look-up table. The laminar flame speed, $s_L$, is then transmitted to the engine thermodynamics module 116.

The laminar flame speed, $s_L$, is an instantaneous property of the flame front 404 in the combustion chamber 204. Therefore, the engine thermodynamics module 116 may update the laminar flame speed, $s_L$, as the flame front 404 progresses through the combustion chamber 204. Accordingly, the engine thermodynamics module 116 use the measurement of the flame front 404 in the combustion chamber 204 to track the expansion ratio of the unburned region 400 and the burned region 406. The laminar flame speed, $s_L$, is updated by calculating updated laminar flame speed, $s_L$, as the physical state of the engine 202. For example, the engine thermodynamics module 116 may continually update the laminar flame speed, $s_L$, or update the laminar flame speed, $s_L$, at a predetermined interval of time. In another embodiment, the engine thermodynamics module 116 may be triggered to update the laminar flame speed, $s_L$, by the engine kinematics module 114 in response to the physical state of the engine 202 changing or the engine kinematics module 114 receiving additional received engine parameters. Accordingly, the laminar flame speed, $s_L$, can be calculated in real-time to track the changes in the flame front 404 during combustion.

The processes in the flame brush stage that are described below, are performed, coordinated, or facilitated by the flame kinematics module 118. The flame kinematics module 118 may additionally utilize other components of the operating environment 100, including machine systems 126 and the machine sensors 128 shown in FIG. 1.

In the flame brush stage the method 300 includes, at block 306, the flame kinematics module 118 calculating flame brush thickness dynamics and turbulent flame speed. The flame brush thickness dynamics may include the flame brush thickness, turbulent flame speed, spherical flame radius, volume fraction burned, lookup flame radius and/or lookup unburned volume. The flame kinematics module 118 may employ flame propagation equations and flame brush dynamics to determine the flame brush dynamics based on the laminar flame speed, $s_L$ and engine parameters, such as the turbulent kinetic energy and integral length scale of turbulence.

In one embodiment, the calculation may be based, at least in part, on the solution of a dynamic equation which determined the flame brush thickness net change rate based on the flame brush thickness growth due to vortex stretching (i.e., chain branching) and the flame brush thickness decay due to self-annihilation (i.e., chain termination). The dynamic equation can be written as:

$$\frac{d}{dt}l_{fb|net} = \frac{d}{dt}l_{fb|growth} + \frac{d}{dt}l_{fb|decay}$$

where $l_{fb|net}$ is the flame brush thickness net change rate, the $l_{fb|growth}$ is the flame brush thickness growth, and $l_{fb|decay}$ is the flame brush thickness decay. This can also be written as:

$$\frac{d}{dt}l_{fb|net} = 2u_{ch} + s_L(1 - \sec\theta)$$

where $u_{ch}$ is the characteristic eddy velocity.

Figure 5B:
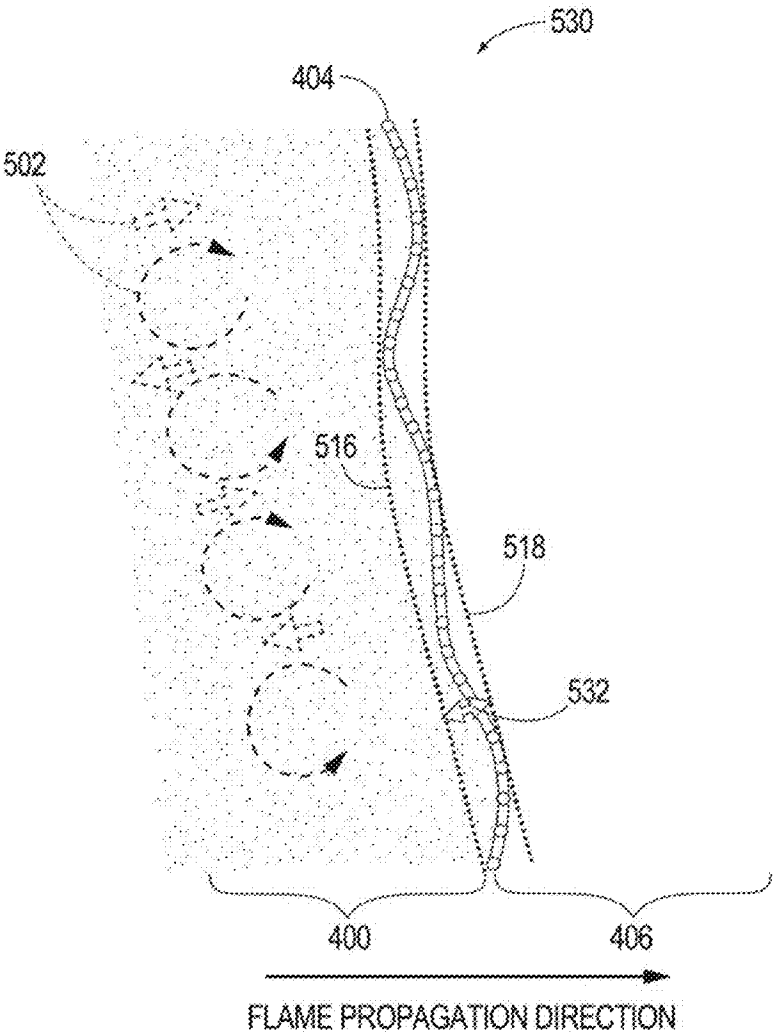
FIG. 5B is a schematic diagram of another flame front affected by turbulent eddies according to an exemplary embodiment.
Figure 5A:
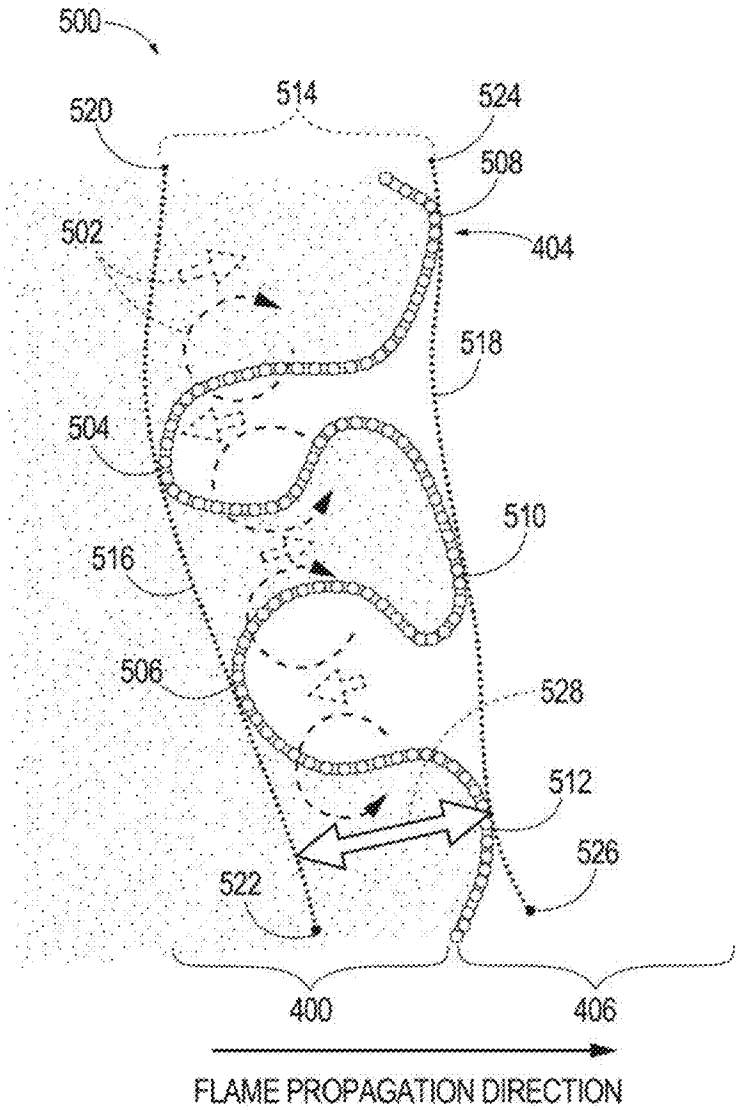
FIG. 5A is a schematic diagram of a flame front affected by turbulent eddies according to an exemplary embodiment.

As one example, the flame brush thickness growth and the flame brush thickness decay will be described with respect to the combustion chamber 204. Specifically, in FIGS. 4A-4C, the flame front 404 within the combustion chamber 204 was considered locally without the large scale effects of turbulence described by the flame brush thickness dynamics. Accordingly, the flame front 404 shown in FIGS. 4B and 4C is illustrates as smooth and unwrinkled. In FIGS. 5A and 5B the flame front 404 is affected by turbulent eddies 502. The flame brush thickness dynamics are values that describe the behavior of the flame brush. For example, the flame brush thickness dynamics include the flame brush growth 500 and the flame brush decay 530 which are illustrated in FIGS. 5A and 5B, respectively. First turning to FIG. 5A, here the flame front 404 is a line that is defined by a plurality of inflection points where combustion is actively occurring. Accordingly, the flame front 404 represents the area in the combustion chamber 204 between the unburned region 400 and the burned area 406.

Due to the turbulent eddies 502, the flame front 404 is irregular. For example, some portions of the flame front 404 extend towards the unburned region 400 and then away from the unburned region 400 in the flame propagation direction, thereby forming one or more valleys in the flame front 404, such as a first flame front valley 504 and a second flame front valley 506. Likewise, some portions of the flame front 404 extend towards the burned area 406 in the flame propagation direction and then away from the burned area 406, thereby forming one or more peaks in the flame front 404, such as a first flame front peak 508, a second flame front peak 510, and a third flame peak 512. Accordingly, the inflection points of the flame front 404 may wind toward and away from the unburned region 400 and/or the burned area 406.

A flame brush band 514 has a variable width in the flame propagation direction that is bounded by a first line 516 and a second line 518. The first line 516 successively connects a first unburned point 520 to an nth unburned burned point 522. The first line 516 tangentially approaches one or more of the valleys, such as the first flame front valley 514 and the second flame front valley 506. The second line 518 successively connects a first burned point 524 to an nth burned point 526. The second line 518 tangentially approaches one or more of the peaks, such as the first flame front peak 508, the second flame front peak 510, and the third flame peak 512. Neither the first line 516 nor the second line 518 intersects the flame front 404.

Because the first line 516 and the second line 518 are based on the flame front 404, which is irregular, the flame brush thickness is variable. The flame brush thickness may include an increasing flame brush thickness 528 or a decreasing flame brush thickness 532 based on whether the flame brush thickness is growing or deteriorating. The increasing flame brush thickness 528 extends from an unburned point on the first line 516 to a burned point on the second line 518. For example, the increasing flame brush thickness 528 may be measured from the first unburned point 520 to the first burned point 524. In FIG. 5B, the flame front 404 is exhibiting flame brush decay 530 affected by turbulent eddies 502 such that the flame brush thickness is a decreasing flame brush thickness 532. In a combustion scenario, the flame brush thickness increasing as an increasing flame brush thickness 528 and/or decreasing as the decreasing flame brush thickness 532 may be determined in the combustion chamber 204. For example, the flame kinematics module 118 may calculate the flame brush thickness dynamics, at block 306 of FIG. 3, based on sensor data from the combustion sensor 134 which measures the increasing flame brush thickness 528 and/or the decreasing flame brush thickness 532.

Returning to the dynamic equation given above, the flame kinematics module 118 may receive, measure, or calculate the flame brush thickness dynamics according to:

$$\frac{d}{dt}l_{fb}\Big|_{net} = \frac{d}{dt}l_{fb}\Big|_{growth} + \frac{d}{dt}l_{fb}\Big|_{decay}$$

The flame brush growth is based on flame brush data including a characteristic eddy velocity, $u_{ch}$, such that:

$$\frac{d}{dt}l_{fb}\Big|_{growth} = 2u_{ch}$$

Figure 5C:
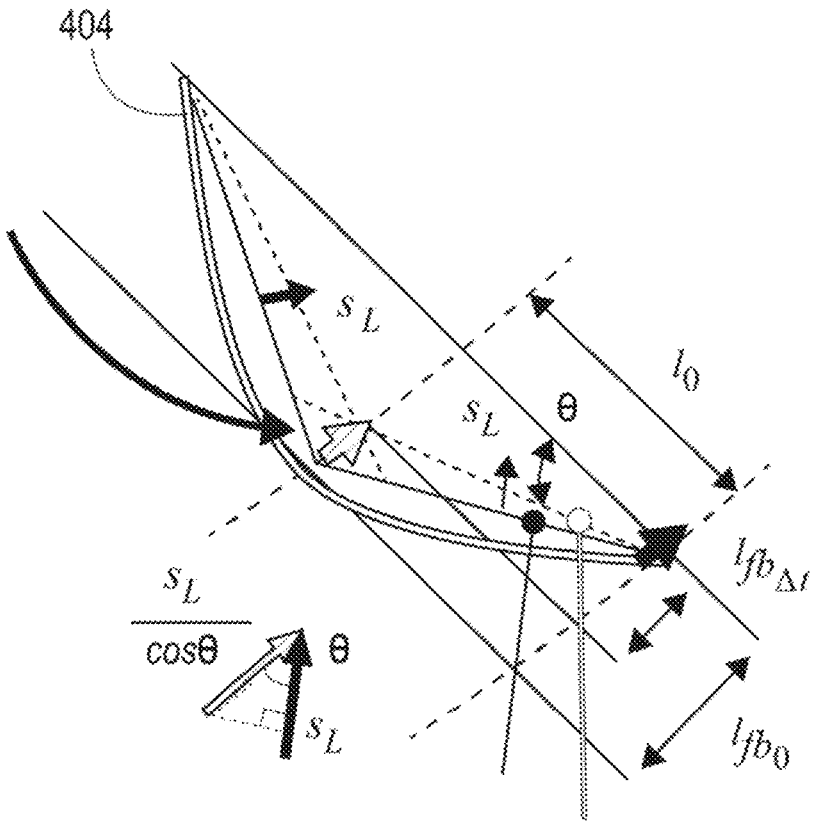
FIG. 5C is a schematic diagram of the geometric relationships that define the flame front according to an exemplary embodiment.

Therefore, the flame brush growth is a calculation that is an instantaneous representation of the increasing flame brush thickness 528 that is based on the characteristic eddy velocity of the turbulent eddies 502, shown in FIG. 5. In some embodiments, the characteristic eddy velocity may be based on the turbulent kinetic energy (TKE) and the integral scale of turbulence, $l_0$. The integral scale of turbulence, $l_0$, is a characteristic length scale of the turbulent eddies 502 and is shown in FIG. 5C.

The TKE and integral scale of turbulence, $l_0$, may be pre-calculated from the three-dimensional flow solution and then determined in real time by cross referencing with the physical state of the engine 202. For example, the TKE and the integral scale of turbulence, $l_0$, may be based on the crank angle of the engine 202, the intake manifold pressure, and the speed of the engine 202. In one embodiment, the flame kinematics module 118 may access the TKE and the integral scale of turbulence, $l_0$, from the engine kinematics module 114 or the remote server 136.

Therefore, the characteristic eddy velocity may be based on the physical state of the engine 202 and is defined by:

$$u_{ch}=\sqrt{6\mathrm{TKE}}$$

where TKE is the turbulent kinetic energy.

Accordingly, the flame kinematics module 118 can numerically calculate the flame brush growth. Likewise, the flame brush decay can be numerically calculated based on flame brush data including a laminar flame speed, $S_L$ also shown in FIG. 5C as a vector. As discussed above, the laminar flame speed, $S_L$, may be measured, calculated, or received, for example, from a look-up table, based on the received engine parameters and/or the physical state of the engine 202. Accordingly, the flame brush decay may be given by:

$$\frac{d}{dt}l_{fb}\Big|_{decay} = s_L(1-\sec\theta)$$

where θ is shown in FIG. 5C and represents:

$$\theta = \tan^{-1}\left(\frac{l_{fb}}{l_0}\right)$$

Accordingly, we can mathematically model the flame brush thickness dynamics rather than directly measuring the turbulence. Because, the flame brush growth and the flame brush decay can both be numerically calculated, the flame brush thickness dynamics can be numerically calculated based on the physical state of the engine 202, and more specifically, based on the received engine parameters. The flame brush growth and flame brush decay are instantons values giving a snapshot of the flame brush. The flame kinematics module 118 may update the flame brush growth and flame brush decay, resulting in an evolving sense of the flame brush. For example, the flame brush thickness dynamics may be calculated continually, periodically, and/or in response to other calculations, such as updated laminar flame speeds. Furthermore, other flame brush thickness dynamics, such as the turbulent flame speed, $S_T$, is shown in FIG. 5C and can also be calculated, for example, according to the expression:

$$\frac{s_T}{s_L} = \frac{1+\sec(\theta)}{2}$$

where the turbulent flame speed is $s_T$.

Therefore, the turbulent flame speed is an instantaneous measurement based on the decay rate of the flame brush thickness. Furthermore, the flame brush thickness dynamics can be calculated and updated in real-time because the flame brush thickness dynamics equations are given by lightweight algebraic representations of a 1D nonlinear ordinary differential equation.

The turbulent flame speed may be used to determine the instantaneous flame radius of a spherically expanding flame that is outwardly propagating from the spark plug gap center. For example, the flame brush thickness can be determined at a time=0, represented by $l_{fb_0}$, and again at a time=Δt, represented by $l_{fb_{\Delta t}}$, as shown in FIG. 5C, to show the evolving thickness of the flame front 404.

At block 308, the method 300 includes the mass continuity module 120 calculating a mass burned fraction. The mass burned fraction may be based on the engine parameters, the flame brush thickness dynamics including the flame brush growth and the flame brush decay, and/or the turbulent flame speed. In particular, the mass continuity module 120. The processes in the modeling stage that are described below, are performed, coordinated, or facilitated by the mass continuity module 120. For example, the mass continuity module 120 may use a physical form of the Wiebe function to calculate the mass fraction burned based on the turbulent flame speed, spherical flame area, and unburned volume. The mass continuity module 120 may also utilize other components of the operating environment 100, including machine systems 126 and the machine sensors 128.

The flame brush growth is related to the intensity of turbulent eddies 502 caused by eddies in the combustion chamber 204. The flame brush decay is related to the geometric collapsing rate of the flame in the combustion chamber 204. Therefore, the flame brush thickness dynamics mathematically describe the manner in which the flame front 404 moves through the combustion chamber 204 consuming the air-fuel mixture.

Furthermore, the turbulent flame speed may be based on the combustion chamber 204. For example, the combustion chamber 204 geometry and the flame radius as the flame front 404 interacts with the chamber walls of the combustion chamber 204. In some embodiments, the interaction of a spherical flame front 404 and the chamber walls are treated as a truncation of the spherical expanding flame. Truncated spherical flame area and the unburned volume are pre-calculated maps. The pre-calculated maps may be referenced with the input flame radius, calculated based on the flame brush thickness, and the crank angle of the engine 202, calculated based on the engine parameters. Accordingly, the flame area is calculated as a function of the flame radius and the crank angle. Likewise, the unburned volume is calculated as a function of the flame radius and the crank angle. The mass burned fraction may be a burn ratio calculated according to the relationship shown below:

$$\hat{\rho} = Kt^m = \frac{p_u A_l s_{l,u}}{m_u} = \frac{A_T s_T}{V_u}$$

where $\hat{\rho}$ is the relative density of effective centers, $Kt^m$ is the curve fit, $p_u$ is the physical state parameter from 0D cylinder model, $A_l$ is the laminar flame area, $s_{l,u}$ is the thermo-chemical property of the mixture, and $m_u$ is the physical model from the 0D cylinder model. Further, $A_T$ is the spherical front area, $s_T$ is the turbulent flame speed, and $V_u$ is the volume unburned. Based on the output, the mass continuity module 120 can use the mass fraction burn time history in a cylinder module to determine the chamber pressure-temperature history during the compression and power strokes.

In the modeling stage, the mass continuity module 120 models the operation of the engine 202 based on the flame brush thickness dynamics. In some embodiment, the combustion is modeled by, at block 310, generating one or more efficiency factors to control at least one aspect of the engine 202. In particular, the one or more efficiency factors may control one or more machine systems 126 by setting the spark dynamic, the air to fuel ratio, or other operating parameters.

For example, the mass continuity module 120 mat determine the optimal ignition timing based on any number of combustion targets and control parameters. Unlike the engine kinematics module 114, the engine thermodynamics module 116, and the flame kinematics module 118, which predictively model combustion, the mass continuity module 120 exerts control of the engine 202 by setting efficiency parameters. In some embodiments, the mass continuity module 120 may facilitate the engine kinematics module 114, the engine thermodynamics module 116, and the flame kinematics module 118. For example, the mass continuity module 120 may predict an initial ignition timing to the engine kinematics module 114. The engine thermodynamics module 116 and the flame kinematics module 118 may then predict the mass fraction burned profile based on the initial ignition timing. The mass continuity module 120 may then assess the mass fraction burned profile to determine a revised ignition timing using any number of combustion control parameters. The combustion control parameters may include: combustion phasing, such as the crank angle of 50% mass burned or the crank angle of maximum cylinder pressure, maximum cycle thermal efficiency, maximum indicated mean effective pressure (IMEP), minimum coefficient of variation (COV) of IMEP, unburned zone temperature pressure-temperature time history as may be used for a "knock integral" calculation to predict the onset of unwanted abnormal combustion, among others. The mass continuity module 120 may then control the engine 202 to operate according to the revised ignition timing. Additionally or alternatively, the combustion control module may send the revised ignition timing to the engine kinematics module 114 as an updated ignition timing that can be used as an engine parameter for calculating the mass fraction burned profile, as discussed above.

In this manner, the mass continuity module 120 can make real-time changes to the combustion of the engine 202. For example, suppose that the vehicle 200 is being serviced, the vehicle itself or the model specifications of the vehicle 200 may be used to identify at least one engine parameter associated with the engine 202. Through testing, development, and/or calculation the engine thermodynamics module 116 and the flame kinematics module 118 may then predict the mass fraction burned profile based on the initial ignition timing. The mass fraction burned profile may be used by the mass continuity module 120 to determine if the vehicle 200 has a problem. Additionally or alternatively, the mass fraction burned profile may be used by the mass continuity module 120 to control the engine 202 to operate according to a revised ignition timing. Therefore, the operation of the engine 202 can be set by the one or more efficiency factors based on the flame brush thickness dynamics determined in the flame brush stage. Therefore, the one or more efficiency factors control and modify the operation of the engine 202, based on a real-time mathematical representation of the combustion in the combustion chamber 204. Accordingly, the efficiency factors act as parameters for a feed forward model of combustion.

Figure 6:
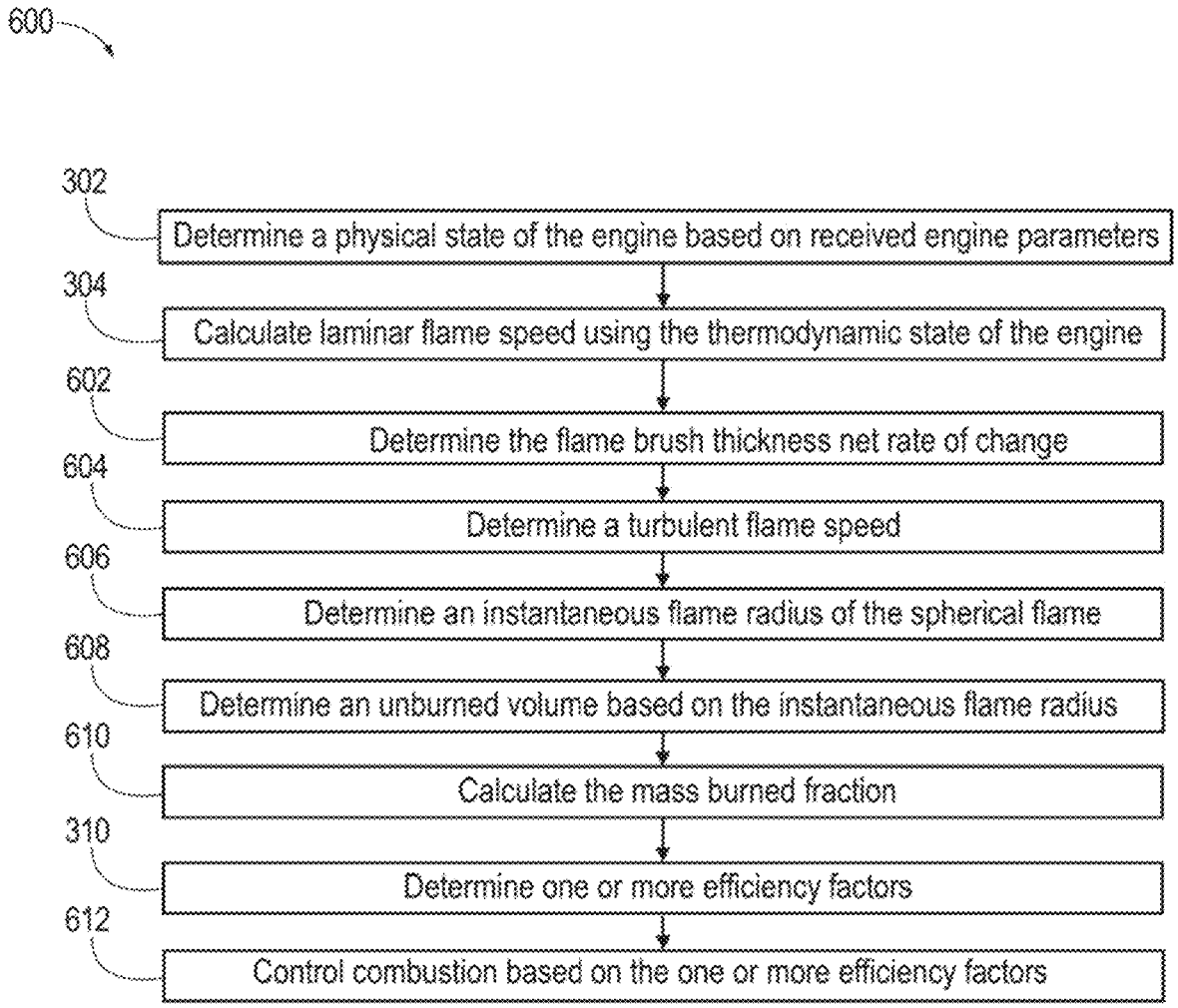
FIG. 6 is another process flow diagram of a method for engine combustion modeling according to an exemplary embodiment.

FIG. 6 is another process flow diagram of a method for engine combustion modeling according to another exemplary embodiment. FIG. 6 will be described with reference to FIGS. 1-5. For example, the method 600 is described with respect to the same four stages described with respect to the method 300, shown in FIG. 3. Thus, like the method 300, while the method 600 will be described by these stages, it is understood that the elements of the method 600 can be organized into different architectures, blocks, stages, and/or processes.

The method 600 includes similar steps as described with respect to the method 300. For example, the method 600 includes determining a physical state of the engine 202 based on one or more received engine parameters, at block 302. The method 600 also includes calculating the laminar flame speed, $S_L$, based on the physical state of the engine 202, at block 304.

At block 602, the method 600 includes determining the flame brush thickness net rate of change based on the flame brush thickness growth rate and the flame brush thickness decay rate. The flame brush thickness growth rate based on the turbulent intensity and/or velocity of large scale turbulent eddies in the combustion chamber 204, as discussed above. The flame brush thickness decay rate is based on the laminar flame speed, $s_L$, which is tracked as a function of the flame brush thickness.

At block 604, the method 600, includes, $s_T$, based on the flame brush thickness dynamics. The turbulent flame speed, $s_T$, is the speed at which the flame front 404 propagates through the turbulent eddies 502 in the combustion chamber 204. Therefore, as opposed to the laminar flame speed, $s_L$, which measures the speed of the flame front 404 based on the local properties, the turbulent flame speed, $s_T$, is based on the large-scale effects of turbulence. As discussed above, the turbulent flame speed, $s_T$, is shown in FIG. 5C and can also be calculated, for example, according to the expression:

$$\frac{s_T}{s_L} = \frac{1 + \sec(\theta)}{2}$$

Therefore, the turbulent flame speed, $s_T$, can be determined based on values the MCD 102 has previously calculated. For example, the engine thermodynamics module 116 calculates the laminar flame speed, $s_L$. The flame kinematics module 118 calculates the flame brush thickness dynamics which includes receiving, measuring, or calculating θ. Accordingly, using the laminar flame speed, $s_L$, and θ, the flame kinematics module 118 calculates the turbulent flame speed, $s_T$ of the flame front 404 moving through the combustion chamber 204.

At block 606, the method 600, includes determining an instantaneous flame radius of the spherical flame based on the turbulent flame speed. The instantaneous flame radius of the spherical flame is the radius of the flame front 404 as it propagates outward from the spark plug 206 through the combustion chamber 204 at a particular point in time. Accordingly, the instantaneous flame radius of the spherical flame may be based on the geometry of the combustion chamber 204. For example, as discussed above, the combustion chamber 204 geometry and the flame radius as the flame front 404 interacts with the chamber walls of the combustion chamber 204.

Returning to FIG. 4B, the ignition point 402, where the flame ignites in the combustion chamber 204, extends outward to the flame front 404, therefore the instantaneous flame radius of the spherical flame is the distance from the ignition point 402 to the flame front 404. The flame kinematics module 118 may receive, measure, or calculate the instantaneous flame radius of the spherical flame. For example the flame kinematics module 118 may calculate the instantaneous flame radius of the spherical flame based on the received engine parameters, such as the ignition timing, and the turbulent flame speed, $S_T$, to determine the distance of the instantaneous flame radius of the spherical flame.

At block 608, the method 600, determine an unburned volume based on the instantaneous flame radius. The unburned volume includes calculating the mass burned fraction based on the instantaneous flame radius of the spherical flame. The unburned volume defines the volume of the air-fuel mix that has not burned during combustion. The unburned volume may be based on the received engine parameters or other engine data. For example, the unburned volume may be based the chamber geometry and the location and the size of the spherical flame and the position of that spherical flame, as defined by the instantaneous flame radius of the spherical flame. The unburned volume may also be based on the instantaneous flame radius and/or the crank angle. In one embodiment, the flame kinematics module 118 may be set with the geometry of the combustion chamber.

At block 610, the method 600, includes calculating the mass burned fraction. The mass burned fraction may be based on the unburned volume. The burn mass ratio reflects how much mass has actually been burned at a particular point in time within the combustion chamber 204. The flame kinematics module 118 may calculate the burn mass ratio using the unburned volume by using the Ideal Gas Law. Because the measurements are instantaneous, the burn mass ratio can be calculated for a specific point in time. Furthermore, the burn mass ratio can be updated in order to determine how the flame propagates during combustion in the combustion chamber 204, thereby modeling the combustion process. For example, the burn mass ratio is updated by calculating an updated turbulent flame speed, $s_T$, as the physical state of the engine 202 changes. The flame kinematics module 118 may continually update the turbulent flame speed, $s_T$, or update the turbulent flame speed, $s_T$, at a predetermined interval of time. In another embodiment, the flame kinematics module 118 may be triggered to update the turbulent flame speed, $s_T$, by the engine kinematics module 114 in response to the physical state of the engine 202 changing or the engine kinematics module 114 receiving additional received engine parameters. In yet another embodiment, the flame kinematics module 118 may be triggered to update the turbulent flame speed, $s_T$, in response to the laminar flame speed, $s_L$, changing. Accordingly, the turbulent flame speed, $s_T$, may be calculated in real-time to track the air-mass fuel being burned in the combustion chamber. Therefore, burn mass ratio can be determined can be tracked during combustion for the engine 202.

The flame kinematics module 118 may generate a laminar flame area evolution model by tracking the mass burned fraction and/or the air-mass fuel being burned in the combustion chamber 204 over time. Accordingly, the laminar flame area evolution model includes aggregated flame brush thickness dynamics for multiple points in time. As discussed above, the laminar flame area evolution model can be used to yield the flame area, $A_f(t)$, and the laminar flame area, $A_l(t)$. In particular, the laminar flame area evolution model integrates the calculations made by the flame kinematics module 118 to describe the behavior of combustion in the combustion chamber 204, thereby making the combustion predictable.

The laminar flame area evolution model can be used to yield the flame area, $A_f(t)$, and the laminar flame area, $A_l(t)$, that would otherwise have to be calculated by feed forward combustion models that are resource and time intensive. The mass continuity module 120 uses the laminar flame area evolution model to determine one or more efficiency factors based on the mass burned fraction. The efficiency factors allow the combustion of the engine 202 to be modeled both in real-time to control the engine 202. The efficiency factors also can be used to predictively set the engine parameters without experimentations or feedback calibration. For example, the laminar flame area evolution model is used to determine one or more efficiency factors. Accordingly, the laminar flame area evolution model is a feed forward model for the engine 202 that accurately model combustion including turbulence.

Therefore, following block 608, the method continues to block 310. At block 310, the method 600 includes determining one or more efficiency factors, as described above with respect to the method 300 of FIG. 3. The efficiency factors may include one or more of ignition timing, engine speed, intake manifold pressure, incoming air mass per cycle, air fuel ratio, and trapped residual gas percentage, among others. As described above, the one or more efficiency factors may control one or more machine systems 126 by setting the spark dynamic, the air to fuel ratio, or other operating parameters. Accordingly, the laminar flame area evolution model is a feed forward model for the engine 202 that accurately model combustion including turbulence. Furthermore, efficiency factors may be identified, modified, or generated to test alternative combustion scenarios based on the laminar flame area evolution model.

At block 612, the method 600, includes controlling combustion in the engine 202 based on the one or more determined efficiency factors. For example, suppose that based on the burn mass ratio, the mass continuity module 120 identifies an efficiency factor that defines ignition timing that may increase the efficiency of combustion in the combustion chamber 204. The mass continuity module 120 may forward the efficiency factor to the ignition firing system 132 to control future combustion in the engine 202. Thus, the mass continuity module 120 may control the engine 202 based on the calculated burn mass ratio and/or the resulting laminar flame area evolution model at any given time.

In some embodiment, controlling combustion in the engine 202 based on the one or more determined efficiency factors may include modifying one or more existing efficiency factors. For example, suppose the existing efficiency factors include ignition timing calculated for a first time that is different that the ignition timing of the determined efficiency factors for a second time. The ignition timing may be changed based on updated efficiency factors such that the engine 202 is controlled based on the ignition timing of the determined efficiency factors. Thus, the efficiency factors can be used to control the engine 202 based on the real-time data coming from the resulting laminar flame area evolution model. Accordingly, the systems and the methods described herein can be used in real-time, in a feed forward manner, to quickly and accurately model the effects of turbulence on a flame front 404 during combustion. Furthermore, the efficiency parameters can be used to modify combustion based on the model of the combustion in real time, which facilitates testing, development, and service of the engine 202.

The systems and methods described herein facilitate collection of information about combustion system behavior. As described herein, a computer-implemented method for engine combustion modeling is provided. The method includes determining the thermodynamic state of the engine combustion chamber based on received engine parameters. The laminar flame speeds of the combustible mixture are determined based on tabulated measurement results or from correlations available in the literature. The dynamics of the turbulent flame brush thickness are calculated using a 1D nonlinear ordinary differential equation. The mass fraction burned ratio is found by tracking the motion of a presumed truncated spherical flame front as it propagates through the combustion chamber using the mass continuity equation. One or more engine control calibration efficiency factors are then determined based on the resultant mass fraction burned ratio. One or more efficiency factors control at least one aspect of the engine.

Likewise, a system for engine combustion modeling is provided. The system includes an engine kinematics module, an engine thermodynamics module, a flame kinematics module, and a mass continuity module. The engine kinematic models determines the position of the piston and the resulting instantaneous combustion chamber as a function of crank angle. The engine thermodynamics module determines the thermodynamic state of the chamber volume based on received engine parameters. The flame kinematics module tracks the dynamic motion of the turbulent flame within the combustion chamber which includes calculating the turbulent flame brush thickness using a 1D nonlinear ordinary differential equation and the determination of the transient turbulent flame speed from the dynamics of the flame brush thickness. The mass continuity module determines the mass fraction burned of the combustible mixture which is used to generate one or more efficiency factors. One or more efficiency factors control at least one aspect of the engine.

Although the subject matter has been described in language specific to structural features or methodological acts, it is to be understood that the subject matter of the appended claims is not necessarily limited to the specific features or acts described above. Rather, the specific features and acts described above are disclosed as example embodiments.

Various operations of embodiments are provided herein. The order in which one or more or all of the operations are described should not be construed as to imply that these operations are necessarily order dependent. Alternative ordering will be appreciated based on this description. Further, not all operations may necessarily be present in each embodiment provided herein.

As used in this application, "or" is intended to mean an inclusive "or" rather than an exclusive "or". Further, an inclusive "or" may include any combination thereof (e.g., A, B, or any combination thereof). In addition, "a" and "an" as used in this application are generally construed to mean "one or more" unless specified otherwise or clear from context to be directed to a singular form. Additionally, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising".

Further, unless specified otherwise, "first", "second", or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel. Additionally, "comprising", "comprises", "including", "includes", or the like generally means comprising or including, but not limited to.

It will be appreciated that various embodiments of the above-disclosed and other features and functions, or alternatives or varieties thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A computer-implemented method for engine combustion modeling of an engine having a combustion chamber, the computer-implemented method comprising:

determining a physical state of the engine based on received engine parameters;

calculating laminar flame speeds associated with a flame in the combustion chamber based on the physical state of the engine;

calculating flame brush thickness dynamics including flame brush growth and flame brush decay, wherein the flame brush growth is based on the received engine parameters, and wherein the flame brush decay is based on the laminar flame speed;

calculating a mass burned fraction based on the flame brush thickness dynamics; and determining one or more efficiency factors, based on the mass burned fraction, to control at least one aspect of the engine.

2. The computer-implemented method of claim 1, further comprising generating a laminar flame area evolution model that tracks the mass burned fraction at a first time and a second time, and wherein the one or more efficiency factors are based on the first time and an updated efficiency factor is based on the second time.

3. The computer-implemented method of claim 1, wherein a laminar flame speed is a local measurement of the flame.

4. The computer-implemented method of claim 1, wherein the flame brush thickness dynamics track the flame affected by turbulent eddies in the combustion chamber.

5. The computer-implemented method of claim 1, wherein the received engine parameters include one or more of ignition timing, engine speed, intake manifold pressure, incoming air mass per cycle, air fuel ratio, trapped residual gas percentage.

6. The computer-implemented method of claim 1, wherein the received engine parameters are received from one or more machine sensors or machine systems.

7. The computer-implemented method of claim 1, wherein the flame brush growth corresponds to a flame brush thickness that is increasing and is measured from a first unburned point to a first burned point, and wherein the flame brush decay corresponds to the flame brush thickness that is decreasing and is measured from the first unburned point to the first burned point.

8. The computer-implemented method of claim 7, wherein the flame brush thickness is defined by a flame brush band that is bounded by a first line and a second line, wherein the first line successively connects the first unburned point to an nth unburned burned point, and wherein the second line successively connects the first burned point to an nth burned point.

9. The computer-implemented method of claim 8, wherein the flame includes a flame front having some portions that extend towards an unburned region of the combustion chamber and away from the unburned region to form one or more valleys in the flame front and one or more peaks in the flame front, and wherein the first line tangentially approaches at least one valley of the one or more valleys, and wherein the second line tangentially approaches at least one peak of the one or more peaks.

10. The computer-implemented method of claim 9, wherein neither the first line nor the second line intersects the flame front.

11. A system for engine combustion modeling of an engine having a combustion chamber, the system comprising:

a processor;

an engine kinematics module, implemented via the processor, configured to determine a physical state of the engine based on received engine parameters;

an engine thermodynamics module, implemented via the processor, configured to calculate a laminar flame speed of a flame in the combustion chamber based on the physical state of the engine;

a flame kinematics module, implemented via the processor, configured to calculate flame brush thickness dynamics based on the laminar flame speed and calculates a mass burned fraction based on the flame brush thickness dynamics; and a mass continuity module, implemented via the processor, configured to determine one or more efficiency factors, based on the mass burned fraction, to control at least one aspect of the engine.

12. The system of claim 11, wherein the flame brush thickness dynamics include flame brush growth and flame brush decay, wherein the flame brush growth is based on the received engine parameters, and wherein the flame brush decay is based on the laminar flame speed.

13. The system of claim 12, wherein the flame brush growth corresponds to a flame brush thickness that is increasing and is measured from a first unburned point to a first burned point, and wherein the flame brush decay corresponds to the flame brush thickness that is decreasing and is measured from the first unburned point to the first burned point.

14. The system of claim 11, wherein the flame kinematics module is further configured to generate a laminar flame area evolution model that tracks the mass burned fraction at a first time and a second time, and wherein the one or more efficiency factors are based on the first time and an updated efficiency factor is based on the second time.

15. A non-transitory computer-readable storage medium storing instructions that, when executed by a computer, causes the computer to perform a method comprising:

determining a physical state of an engine, having a combustion chamber, based on received engine parameters;

calculating laminar flame speeds associated with a flame in the combustion chamber based on the physical state of the engine;

calculating flame brush thickness dynamics including flame brush growth and flame brush decay, wherein the flame brush growth is based on the received engine parameters, and wherein the flame brush decay is based on the laminar flame speed;

calculating a mass burned fraction based on the flame brush thickness dynamics; and determining one or more efficiency factors, based on the mass burned fraction, to control at least one aspect of the engine.

16. The non-transitory computer-readable storage medium of claim 15, further comprising generating a laminar flame area evolution model that tracks the mass burned fraction at a first time and a second time, and wherein the one or more efficiency factors are based on the first time and an updated efficiency factor is based on the second time.

17. The non-transitory computer-readable storage medium of claim 15, wherein a laminar flame speed is a local measurement of the flame.

18. The non-transitory computer-readable storage medium of claim 15, wherein the flame brush thickness dynamics track the flame affected by turbulent eddies in the combustion chamber.

19. The non-transitory computer-readable storage medium of claim 15, wherein the received engine parameters include one or more of ignition timing, engine speed, intake manifold pressure, incoming air mass per cycle, air fuel ratio, trapped residual gas percentage.

20. The non-transitory computer-readable storage medium of claim 15, wherein the flame brush growth corresponds to an increasing flame brush thickness measured from a first unburned point to a first burned point.

* * * * *